US012607035B2

(12) United States Patent
Kincaid et al.

(10) Patent No.: US 12,607,035 B2
(45) Date of Patent: Apr. 21, 2026

(54) FENCE SYSTEM

(71) Applicants: Brett Robert Kincaid, Underhill, VT (US); Marianne Wanda Menger, Underhill, VT (US)

(72) Inventors: Brett Robert Kincaid, Underhill, VT (US); Marianne Wanda Menger, Underhill, VT (US)

( * ) Notice: Subject to any disclaimer, the term of this patent is extended or adjusted under 35 U.S.C. 154(b) by 274 days.

(21) Appl. No.: 18/420,237

(22) Filed: Jan. 23, 2024

(65) Prior Publication Data

US 2024/0254801 A1 Aug. 1, 2024

Related U.S. Application Data

(60) Provisional application No. 63/481,623, filed on Jan. 26, 2023.

(51) Int. Cl.
*E04H 17/16* (2006.01)
*E04H 17/20* (2006.01)

(52) U.S. Cl.
CPC ..... *E04H 17/16* (2013.01); *E04H 17/20* (2013.01)

(58) Field of Classification Search
CPC ... E04H 17/16; E04H 17/1602; E04H 17/161; E04H 17/163; E04H 17/164; E04H 17/165; E04H 17/166; E01F 15/08
USPC ..... 256/24, 27; D25/40
See application file for complete search history.

(56) References Cited

U.S. PATENT DOCUMENTS 20,005 A * 4/1858 Robison ..... E04H 17/16 256/27
37,372 A * 1/1863 Hatfield ..... E04H 17/16 256/31
50,446 A * 10/1865 Bryan ..... E04H 17/16 105/461
66,129 A * 6/1867 Chandler ..... E04H 17/009 256/27
93,198 A * 8/1869 Harrison ..... E04H 17/16 256/31
106,670 A * 8/1870 Curtis ..... E04H 17/16 256/24
140,273 A * 6/1873 Huffman ..... E04H 17/16 256/24
150,308 A * 4/1874 Elliott ..... E04H 17/16 52/298
170,055 A * 11/1875 Cluxton ..... E04H 17/1602 256/27

(Continued)

FOREIGN PATENT DOCUMENTS

DE 10053921 A1 * 5/2002 ..... E04H 17/1465
GB 2434383 A * 7/2007 ..... E04H 17/165

*Primary Examiner* — Amber R Anderson

(74) *Attorney, Agent, or Firm* — Oppenhuizen Law PLC; David L. Oppenhuizen

(57) ABSTRACT

A fence system for a fence includes a post having a top end and a bottom end adapted to be secured to the ground. The fence system also includes a plurality of first slats arrayed in a vertical direction along the post and coupled to a first surface of the post. The plurality of first slats extends in a horizontal direction from the post and is disposed on a first side of the post. The fence system also includes a plurality of second slats arrayed in a vertical direction along the post and coupled to a second surface of the post. The plurality of second slats extends in a horizontal direction from the post and is arranged on a second side of the post opposite to the first side.

19 Claims, 14 Drawing Sheets

(56) References Cited

U.S. PATENT DOCUMENTS 176,990 A * 5/1876 Overpeck ..... E04H 17/16 256/31
190,339 A * 5/1877 Kirby ..... E04H 17/16 52/158
209,095 A * 10/1878 Williams ..... E04H 17/16 256/24
252,191 A * 1/1882 Colvin ..... E04H 17/16 256/31
254,504 A * 3/1882 Randall ..... E04H 17/16 256/31
257,688 A * 5/1882 French ..... E04H 17/16 256/24
269,642 A * 12/1882 Culp ..... E04H 17/16 256/28
302,407 A * 7/1884 Huston ..... E04H 17/16 256/62
422,813 A * 3/1890 Ligon ..... E04H 17/16 256/62
457,480 A * 8/1891 Newkirk ..... E04H 17/16 256/62
488,632 A * 12/1892 Neal ..... E04H 17/16 256/31
511,978 A * 1/1894 Trent, Sr. ..... E04H 17/16 256/27
564,857 A * 7/1896 Whisler ..... E04H 17/16 256/31
571,049 A * 11/1896 Lee et al. ..... E04H 17/16 256/62
720,077 A * 2/1903 Simmons ..... E04H 17/16 256/27
798,567 A * 8/1905 Chiber ..... E04H 17/16 256/DIG. 2
834,543 A * 10/1906 Wittinghill ..... E04H 17/16 256/28
3,391,493 A * 7/1968 Wong ..... E04H 17/166 49/394
4,126,926 A * 11/1978 D'Amico ..... B23P 15/12 29/446
4,174,096 A * 11/1979 Campbell ..... E05D 7/081 D25/150
2011/0001104 A1* 1/2011 Rowley ..... E04H 17/143 29/525
2020/0263370 A1* 8/2020 Tryon ..... G10K 11/162

* cited by examiner

FENCE SYSTEM

BACKGROUND OF THE INVENTION

1. Field of the Invention

The present disclosure pertains to a fence. More particularly, the present disclosure pertains to a fence system used for creating a fence along a boundary.

2. Description of the Prior Art

It is well known that fencing is used to create a boundary or enclose a space. Traditional fence systems have an overly complicated design and a lot of physical effort is required in installation. Moreover, wood fences in particular are often sold as prefabricated fence panels to reduce the time and expense associated with building a custom fence. However, prefabricated fence panels are not readily adjustable for elevation changes and they will result in an undesirably large gap underneath one side of the fence panel along an incline. In addition, prefabricated fence panels in the prior art are also not easily used in undulating or curved areas that are not a straight line, or for relatively shorter sections of fence.

Furthermore, existing prefabricated fence panels are available in preset lengths, typically of eight feet long, which present problems when the desired fence length is less than eight feet, or alternatively a length that is not easily divisible by eight. The result is a fence having one section that is potentially much shorter than the other panels because the final fence section was cut short to meet the remaining length needed. As such, there remains a need for a prefabricated fence panel that allows for more flexibility to adjust the total length of the fence.

SUMMARY OF THE INVENTION

According to an aspect of the disclosure, a fence system for a fence is disclosed. The fence system includes a post having a top end and a bottom end, the bottom end being adapted to be mounted into the ground. The fence system also includes a plurality of first slats arrayed, or stacked, in a generally vertical direction along the post and coupled to a first surface of the post. The plurality of first slats extends in a generally horizontal direction outwardly from the post, and is disposed on a first side of the post. Moreover, the fence system includes a plurality of second slats arrayed in a generally vertical direction along the post and coupled to a second surface of the post. The plurality of second slats extends in a generally horizontal direction from the post and is arranged on a second side of the post opposite to the first side.

For a more complete understanding of the present invention, reference is made to the following detailed description and accompanying drawings. In the drawings, like reference characters refer to like parts throughout the views in which:

DETAILED DESCRIPTION OF A PREFERRED EMBODIMENT

Figure 1:
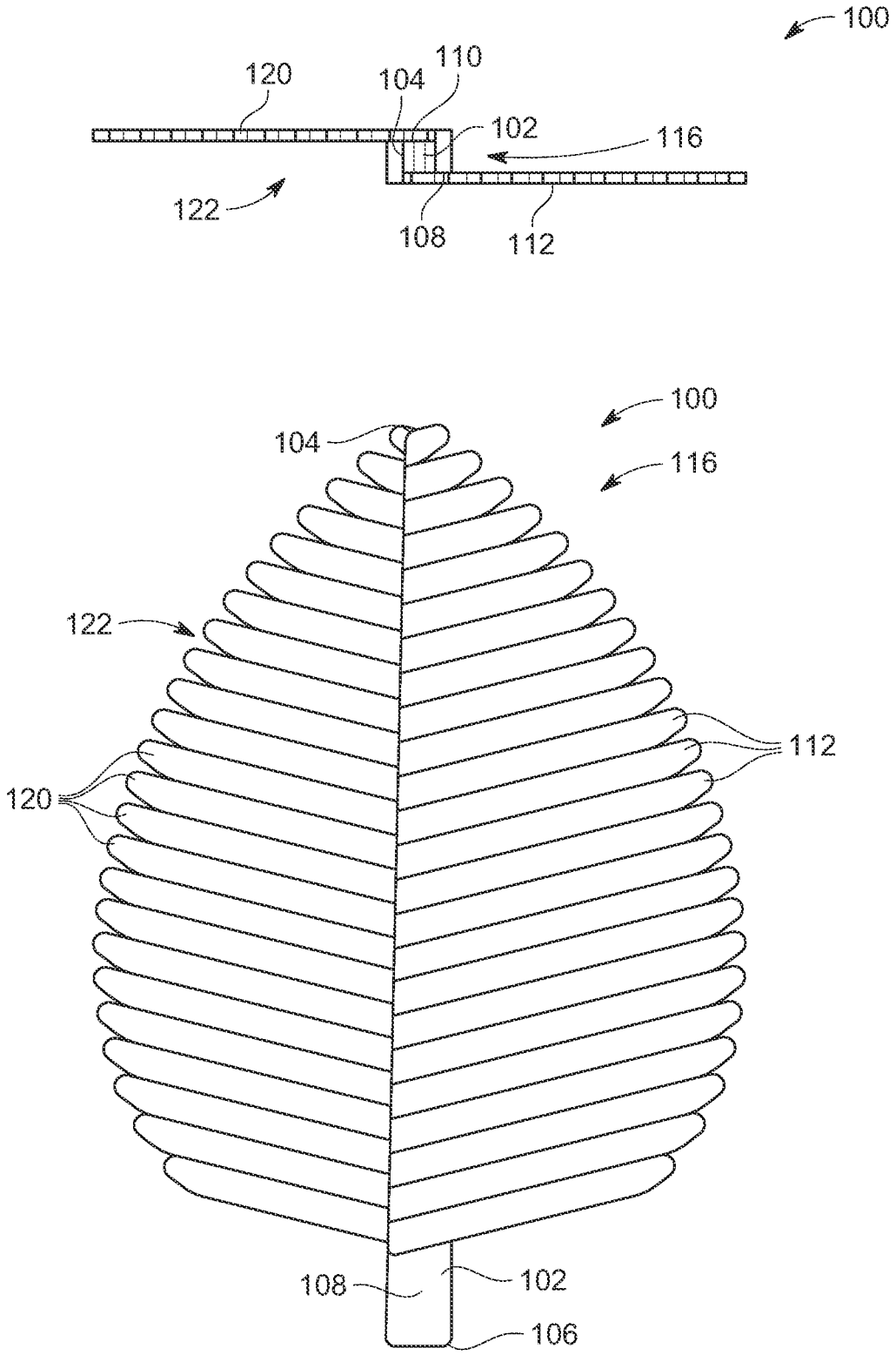
FIG. 1 illustrates a top and front view of a fence system, in accordance with an embodiment of the disclosure.
Figure 2:
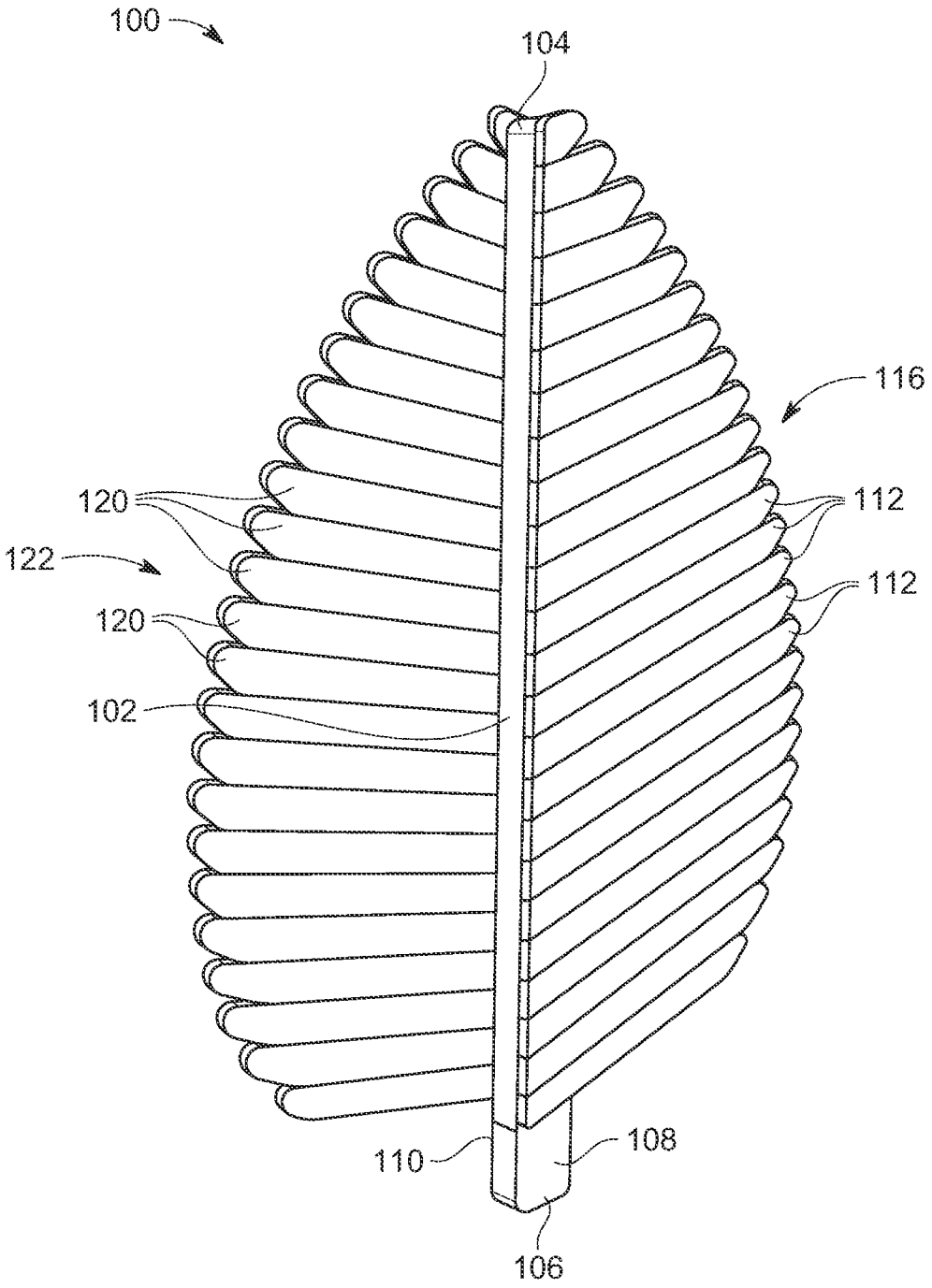
FIG. 2 illustrates a side perspective view of the fence system of FIG. 1, in accordance with an embodiment of the disclosure.

As shown generally in FIGS. 1 and 2 a fence system 100 suitable for fencing a boundary is shown. The fence system 100 is shown to preferably have a tree or shrub shape including a post 102 arranged substantially centrally to the fence system 100 and including a top end 104, a bottom end 106 configured to be inserted inside a ground surface, a front surface 108, and a rear surface 110 arranged opposite to the first surface 106. In an embodiment, the bottom end 106 of the post 102 may be inserted into the ground via a hammer-in mounting spike or via a post-hole. As illustrated, the post 102 preferably has a rectangular cross-section when seen from above. However, the post 102 may have any suitable cross-section, such as, but not limited to square, round, oval, triangular, etc.

Furthermore, the fence system 100 includes a plurality of first slats 112 coupled, or secured, to the post 102 and arrayed along a height of the post 102 from the top end 104 towards the bottom end 106. The first slats 112 are fixedly attached to the post 102, and each first slat 112 is coupled to the front surface 108 of the post 102 and extends generally in a horizontal direction on a first side 116 of the post 102 from the front surface 108. In an embodiment, the first slats 112 extend in a direction substantially perpendicular to the extension of the post 102. However, an angle between the post 102 and the first slats 112 may vary between 30 degrees to 150 degrees. Also, an end of each of the first slats 112 may be tapered to include a shape appearing as a tree leaf.

However, the first slats 112 may include other shapes known in the art. Also, as seen in FIG. 1, the lengths of the first slats 112 may vary from the top end 104 towards the bottom end 106 such that the lengths of the first slats 112 may increase from the top end 104 to a central portion of the array of the first slats 112, and then may decrease in length from the central portion towards the bottom end 106. Accordingly, the lengths of the first slats 112 may be selected such that the outer edges of the first slats 112 together define a substantially convex shape foliage configuration. Alternatively, optionally the lengths of the first slats 112 may be identical. As shown, the first slats 112 are arrayed along the height of the post 102 such that adjacently/consecutively arranged first slats 112 contact each other to cooperatively create a cohesive fence structure.

Figure 11:
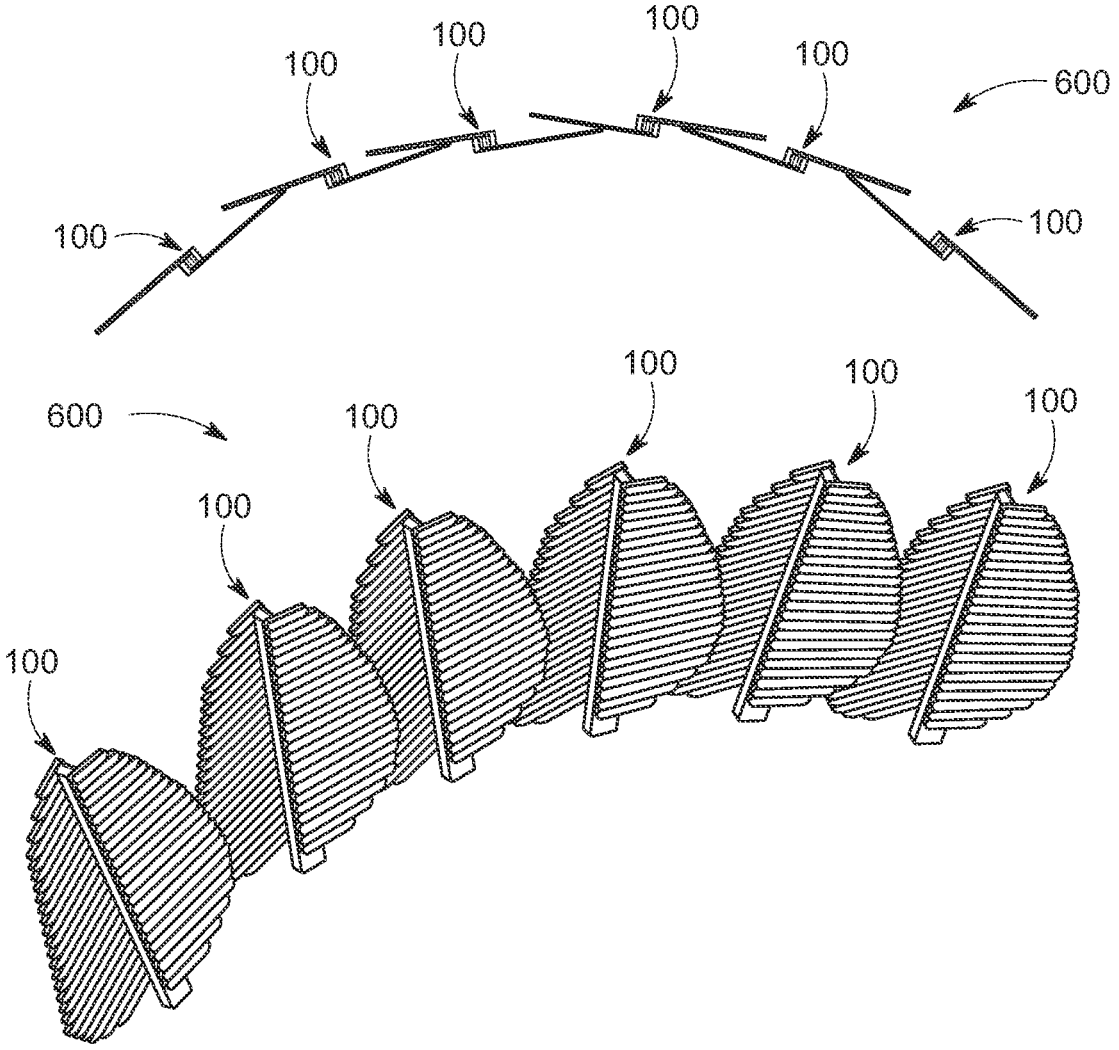
FIG. 11 illustrates a fence having the plurality of fence systems arranged in an arcuate configuration, in accordance with an embodiment of the disclosure.

Moreover, the fence system 100 includes a plurality of second slats 120 coupled to the post 102 and arrayed along a height of the post 102 from the top end 104 towards the bottom end 106. The second slats 120 are fixedly attached to the post 102, and each second slat 120 is coupled to the rear surface 110 of the post 102 and extends in a generally horizontal direction on a second side 122 of the post 102 from the rear surface 110. In an embodiment, the second slats 120 extend in a direction substantially perpendicularly to the extension of the post 120 and in a direction opposite to the direction of extension of the first slats 112 from the post 102. However, an angle between the post 102 and the second slats 120 may vary between 30 degrees to 150 degrees. Also, the end of each of the second slats 120 may be tapered to include a shape appearing as a tree leaf. However, the second slats 120 may include other shapes known in the art. Also, as can be seen from FIGS. 1 and 2, the lengths of the second slats 120 may vary from the top end 104 towards the bottom end 106 such that the lengths of the second slats 120 increase from the top end 104 to a central portion of the array of the second slats 120, and then decrease from the central portion towards the bottom end 106. Accordingly, the lengths of the second slats 120 are selected such that outer edges of the second slats 120 together define a substantially convex shape foliage configuration. However, it may be appreciated that the lengths of the second slats 120 may be identical. As shown, the second slats 120 are arrayed along the height of the post 102 such that adjacently/consecutively arranged second slats 120 contact each other to cooperatively create a cohesive fence structure. Moreover, as shown, the first slats 112 and the second slats 120 are preferably oriented to the post at the same angle with respect to one another, such that the first slats 112 and the second slats 120 mirror one another. In addition, the first slats 112 and the second slats 120 define a gap therebetween. Due to the presence of the gap, consecutively arranged fence systems 100 can be arranged in an arcuate manner, as shown in FIG. 11.

Alternatively, the plurality of first slats 112 and the plurality of second slats 120 may both be secured to the same surface (either the front surface 108 or the rear surface 110). Furthermore, each respective adjacent pair of first slats 112 and second slats 120 may optionally be unitary in construction and formed from a single piece of material extending across the width of the fence system 100.

Figure 3:
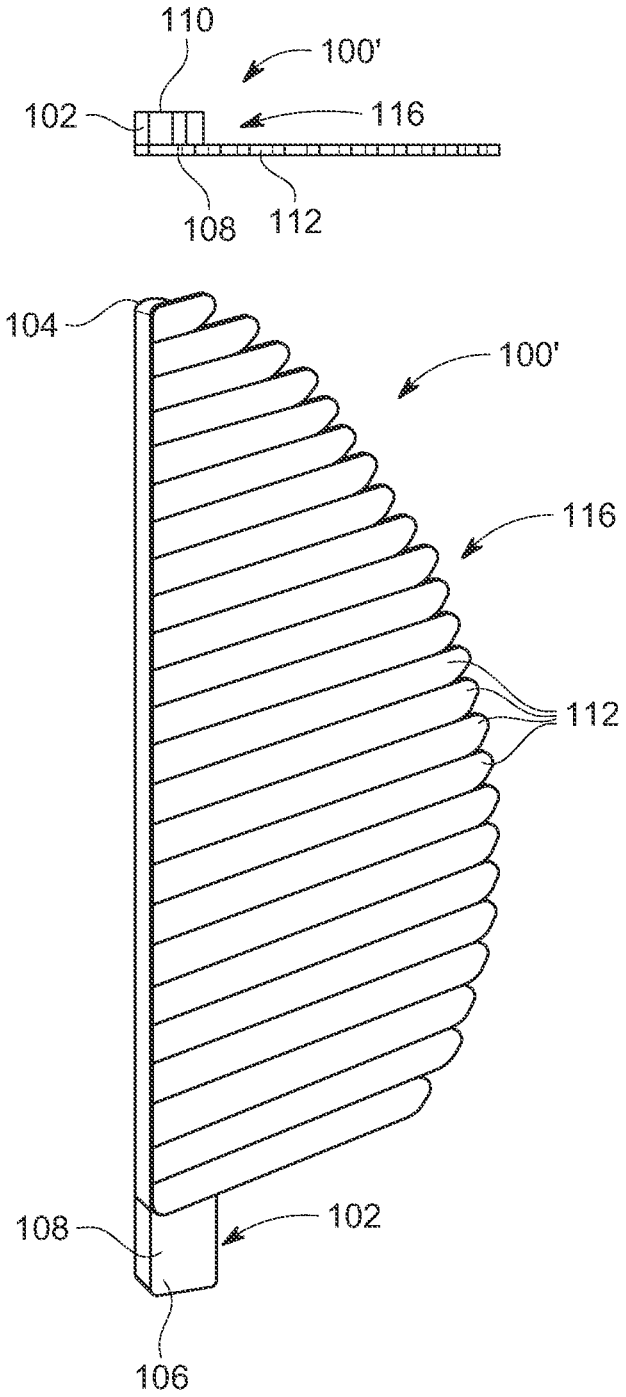
FIG. 3 illustrates a front and top view of an end section of the fence system, according to an embodiment of the disclosure.

Referring to FIG. 3, a fence system 100' adapted to be arranged at an end of a fence is shown. The fence system 100' (also referred to as end fence system 100') is similar to the fence system 100 except that the end fence system 100' includes only one of the first slats 112 and the second slats 120, for example, the first slats 112, and the second slats 120 are omitted from the fence system 100'. The end fence system 100' facilitates an easy connection of a fence with another boundary structure, such as wall, traditional fence, tree, etc.

Figure 4:
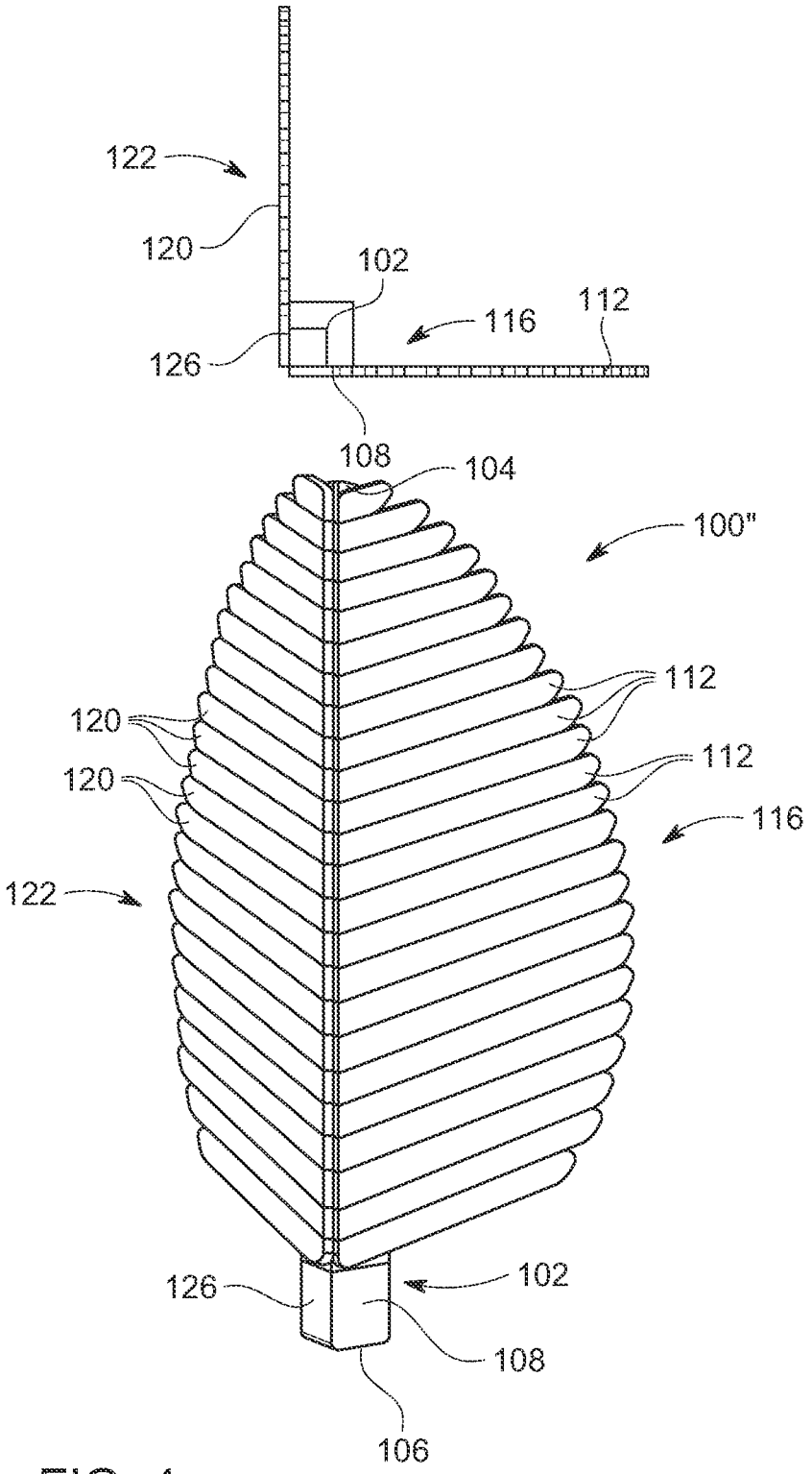
FIG. 4 illustrates a front and top view of a corner section of the fence system, in accordance with an embodiment of the disclosure.

Referring to FIG. 4, a fence system 100" suitable to be arranged at a corner of a fence is shown. The fence system 100" (also referred to as the corner fence system 100") is similar to the fence system 100 except that one of the slats 112, 120, for example, the second slats 120, extends substantially perpendicularly to the direction of the extensions of the other of the slats, for example, the first slats 122. Accordingly, the plurality of second slats 120 are arranged substantially perpendicularly to both the first slats 112 and the post 102. Moreover, the second slats are coupled/connected/engaged to a side surface 126 extending between the front surface 108 and the rear surface 110 and arranged substantially perpendicularly to the front surface 108.

Figure 5:
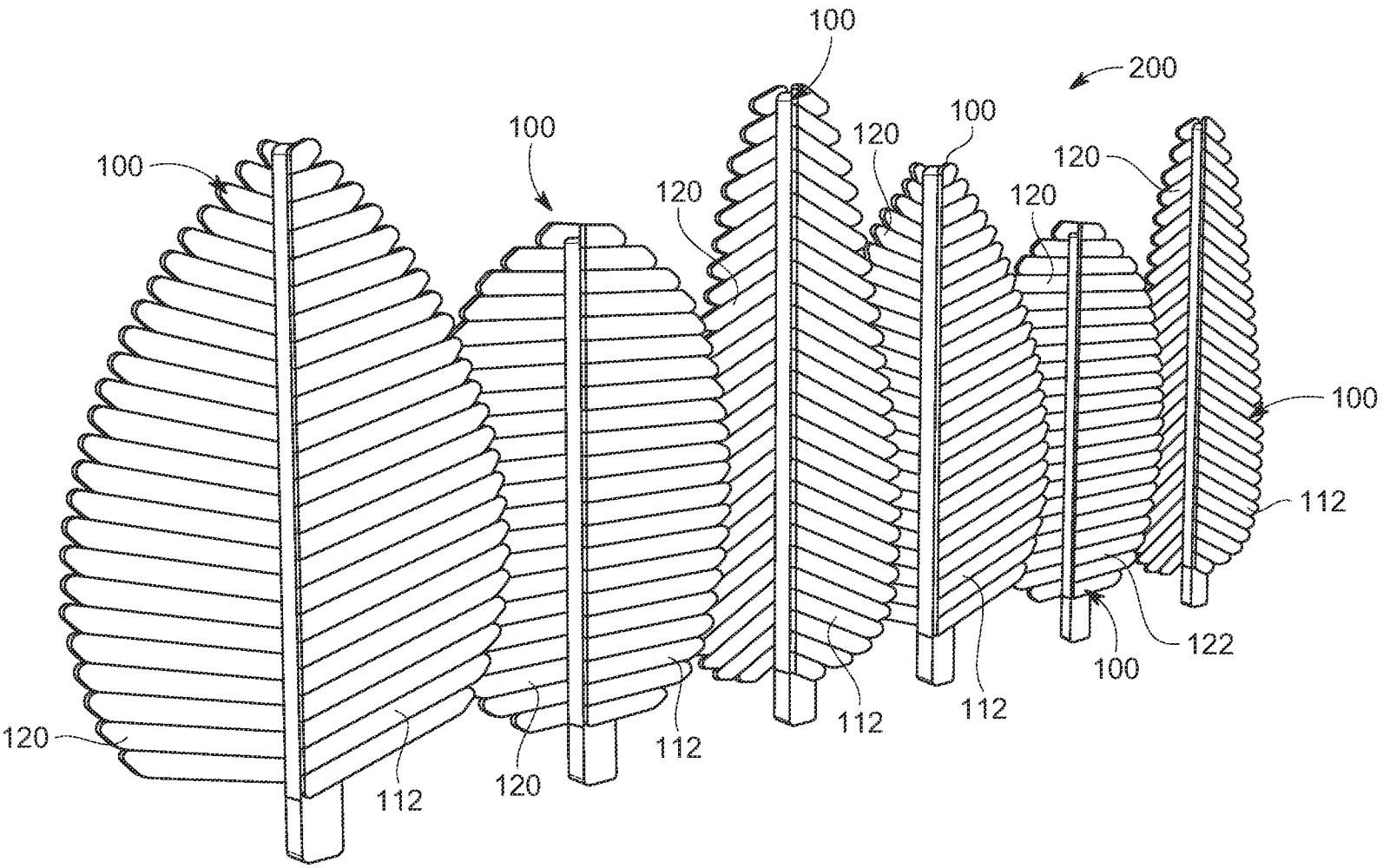
FIG. 5 illustrates a front view of a fence comprising the fence system as seen from an inside of a boundary, in accordance with an embodiment of the disclosure.
Figure 6:
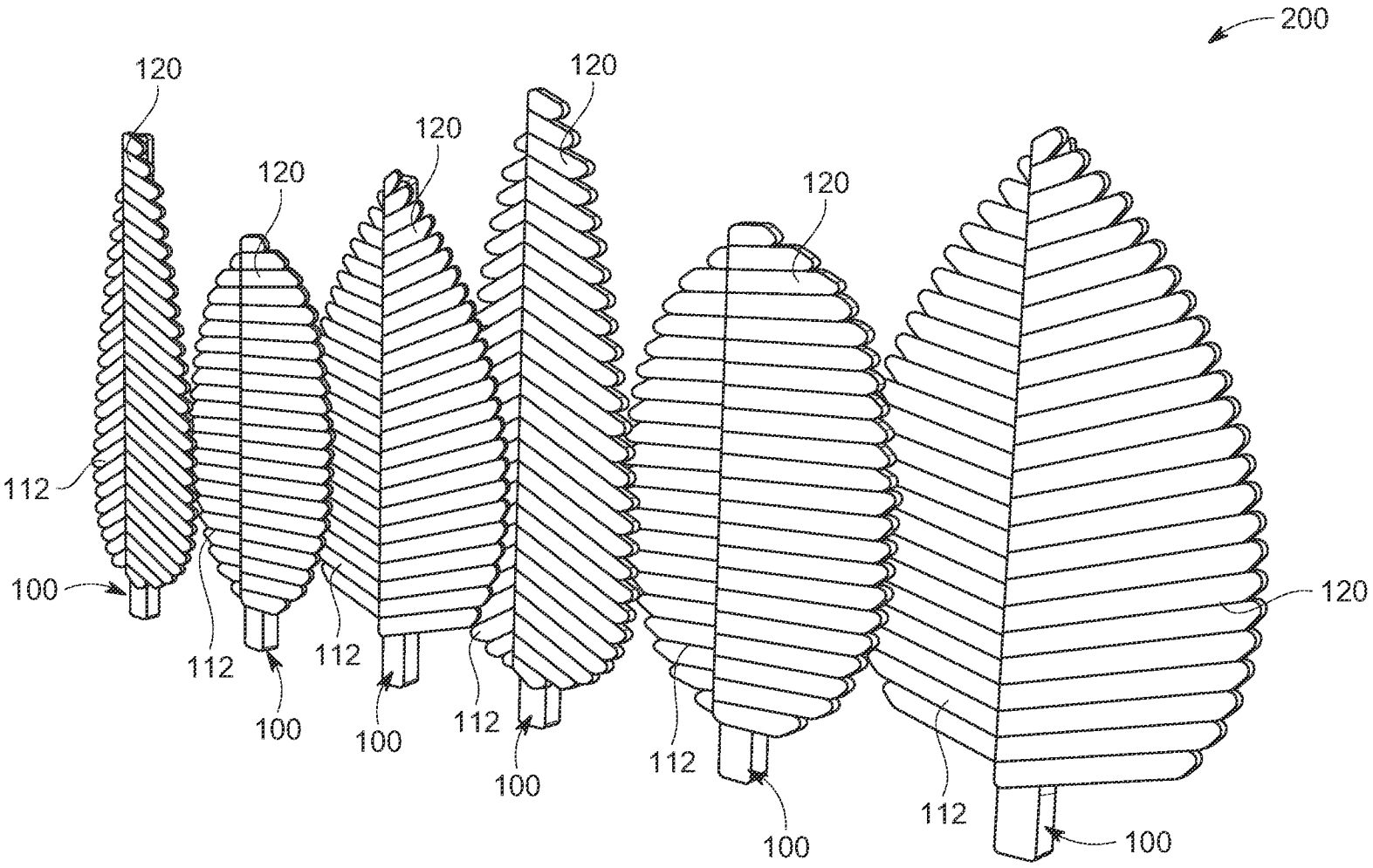
FIG. 6 illustrates a front view of the fence of FIG. 5 as seen from an outside of the boundary, in accordance with an embodiment of the disclosure.

Referring to FIGS. 5 and 6, a fence 200 is formed by arranging the plurality of fence systems 100 as shown. The plurality of fence systems 100 are arranged such that first slats 112 of one fence system 100 is arranged facing the second slats 120 of the adjacently arranged fence system 100 and a gap is defined therebetween, whereby the adjacent fence systems 100 partially overlap with one another. As the fence system 100 is symmetrical about a central vertical plane, a view of the fence 200 from either side is identical, as can be seen from FIG. 5 (inside view) and FIG. 6 (outside view).

Figure 7:
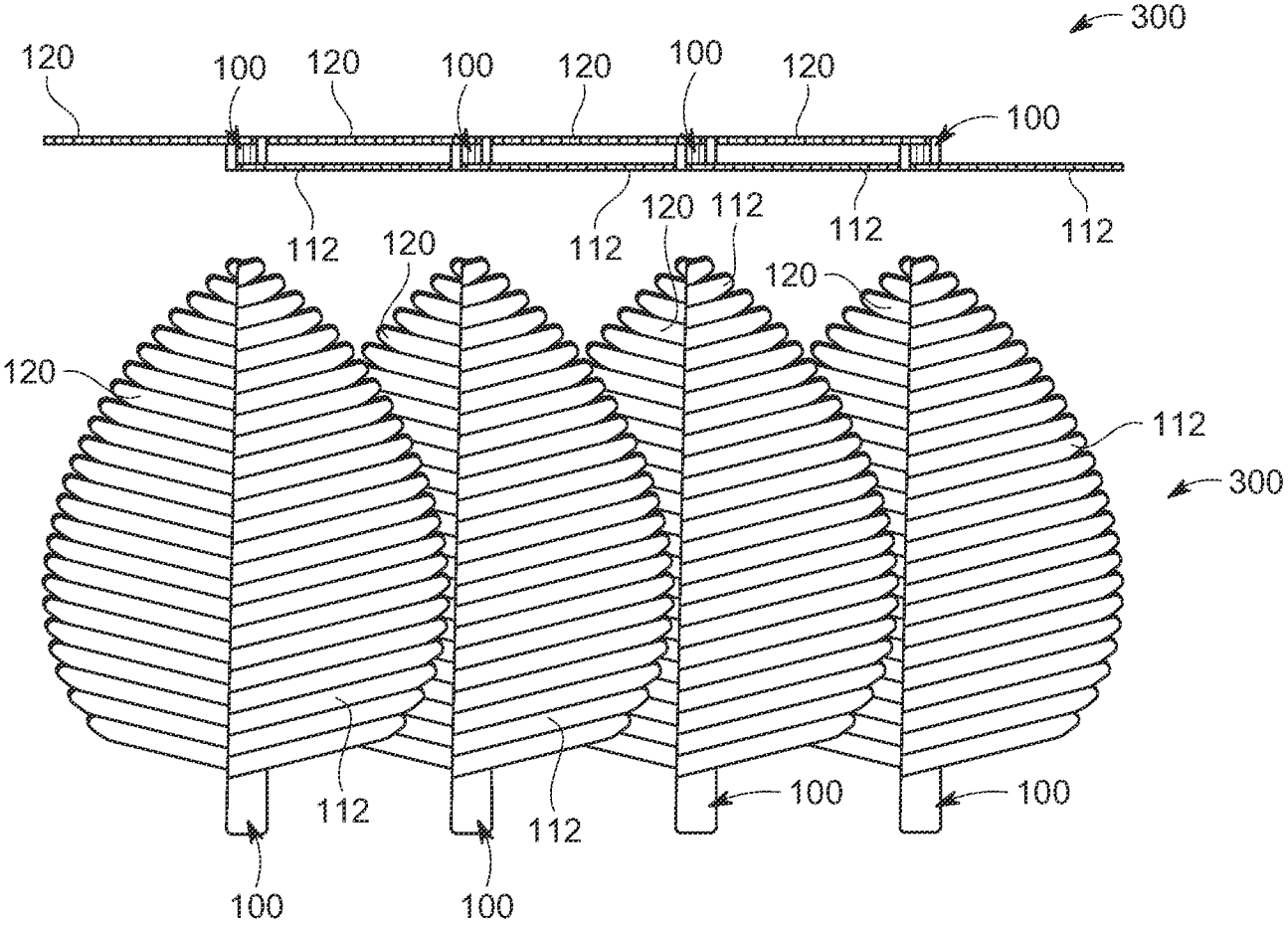
FIG. 7 illustrates a front and top view of a fence with first slats of one fence system completely overlapping with second slats of an adjacently-arranged fence system, in accordance with an embodiment of the disclosure.

FIG. 7 depicts a fence 300 having the plurality of fence systems 100 arranged such that first slats 112 of one fence system 100 are arranged facing the second slats 120 of an adjacent fence system 100, whereby one or more of the first slats 112 and one or more of the facing second slats 120 completely overlap each other. Accordingly, at least one first slat 112 of one fence system 100 extends to a post 102 of the adjacently arranged fence system 100.

Figure 8:
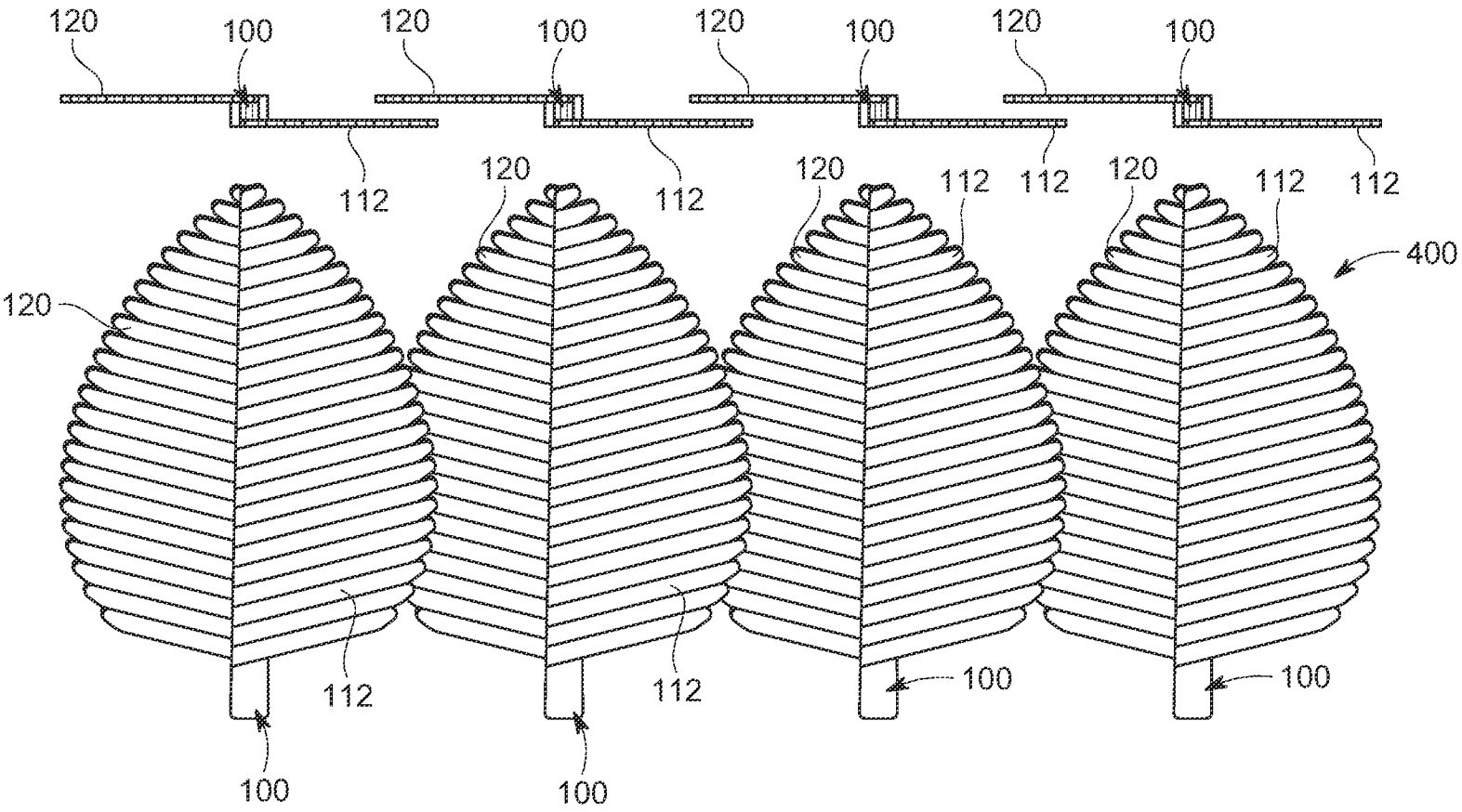
FIG. 8 illustrates a front and top view of a fence with first slats of one fence system partially overlapping with second slats of an adjacently-arranged fence system, in accordance with an embodiment of the disclosure.
Figure 9:
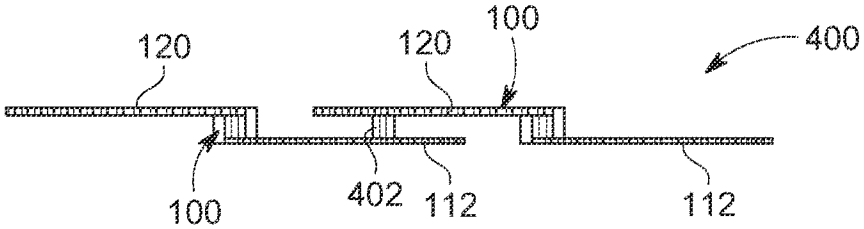
FIG. 9 illustrates a top view of a portion of the fence of FIG. 8 depicting a bolt coupling the first slat of one fence system with the facing second slat of the adjacent fence system, in accordance with an embodiment of the disclosure.

FIG. 8 depicts a fence 400 having the plurality of fence systems 100 arranged such that the first slats 112 of one fence system 100 are arranged facing the second slats 120 of adjacent fence system 100, whereby the first slats 112 and the second slats 120 only partially overlap each other. In some embodiments, as shown in FIG. 9, the first slats 112 of one fence system 100 may be coupled to the overlapping second slats 120 of the adjacently arranged fence system 100 using a plurality of fasteners 402, such as bolts, screws, nails, and so forth. It is to be appreciated that the fence 300 in FIG. 7 and fence 400 in FIG. 8 depict various arrangements of the fence system 100 to demonstrate the flexibility of using and installing the fence system 100, such that the fence system 100 can easily be used to create a fence of any predetermined length by simply varying the number of and the overlap between the fence systems 100 as needed. It is further appreciated that this flexibility is not available in traditional prefabricated fence panels that exist in the prior art.

Figure 10:
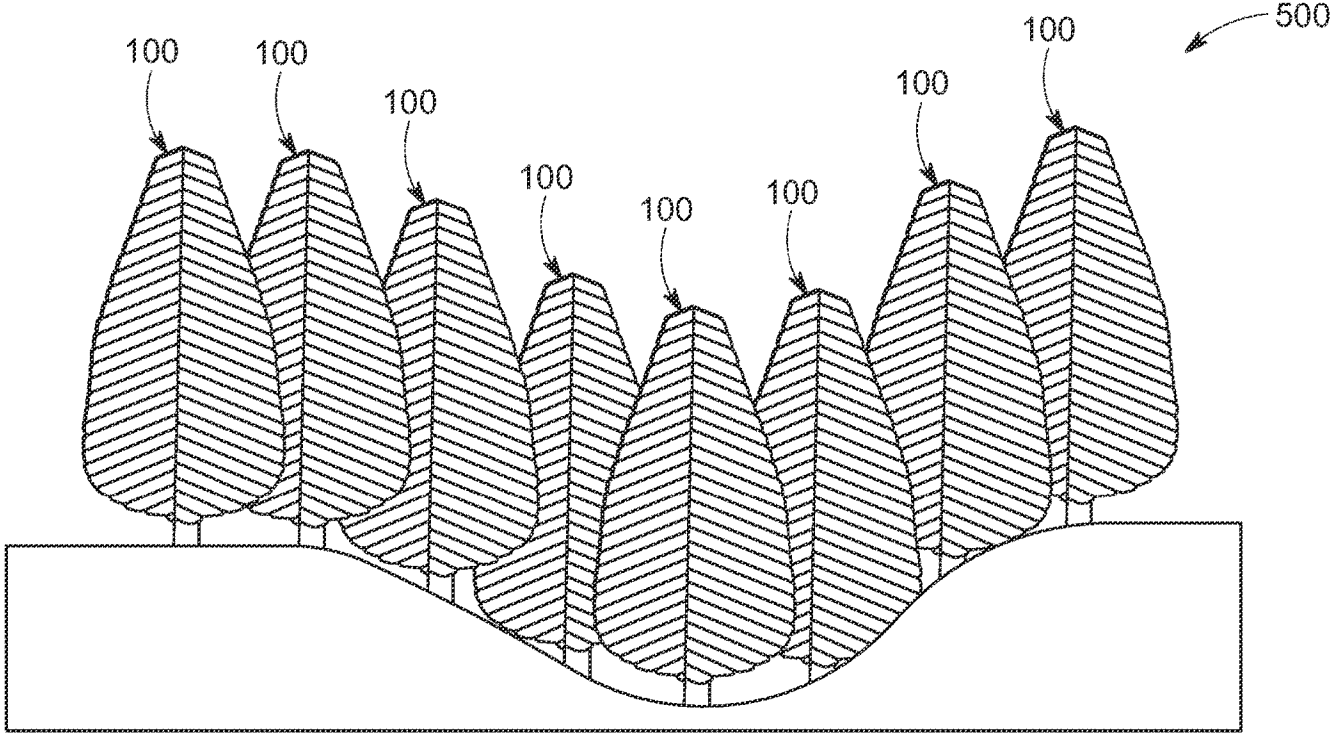
FIG. 10 illustrates a fence having the plurality of fence systems arranged on an undulating terrain, in accordance with an embodiment of the disclosure.

FIG. 10 illustrates a fence 500 having the plurality of fence systems 100 arranged on an uneven/irregular terrain. Due to the shape and configuration of the fence systems 100, the fence systems 100 can be arranged in an effective fence on any type of terrain which minimizes or eliminates gaps along the undulating ground.

FIG. 11 illustrates a fence 600 having the plurality of fence systems 100 arranged in an arcuate manner. Due to the distance/gap between the first slats 112 and the second slats 120, the fence systems 100 may be arranged in a curved/arcuate manner while still being able to overlap the first slats 112 of one fence system 100 with the second slats 120 of the adjacent fence system 100. Accordingly, the fence systems 100 can be arranged in an effective fence on any type of terrain and any orientation.

Figure 12:
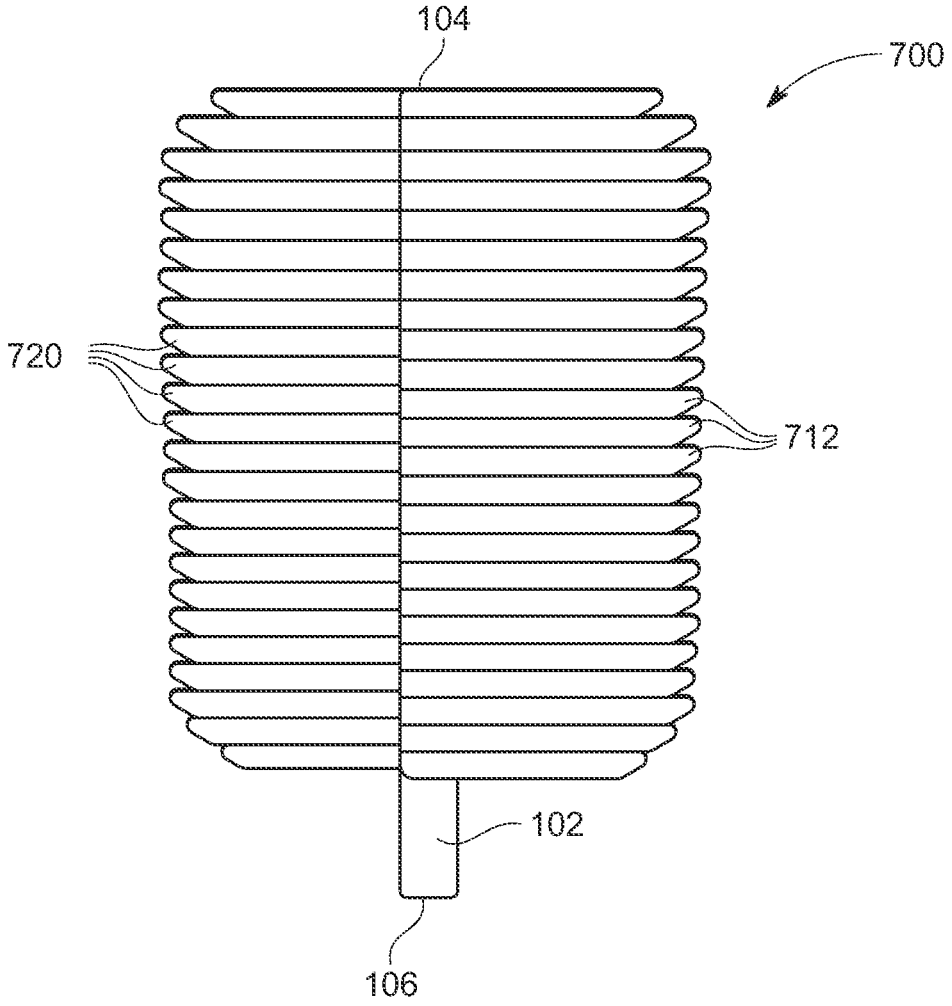
FIG. 12 illustrates a fence system, in accordance with an alternative embodiment of the disclosure.

Referring to FIG. 12, a fence system 700 is shown according to an alternative embodiment of the disclosure. The fence system 700 is similar to the fence system 100 except that first slats 712 of the fence system 120 include identical lengths, and the second slats 720 of the fence system 1200 also have identical lengths.

Figure 13:
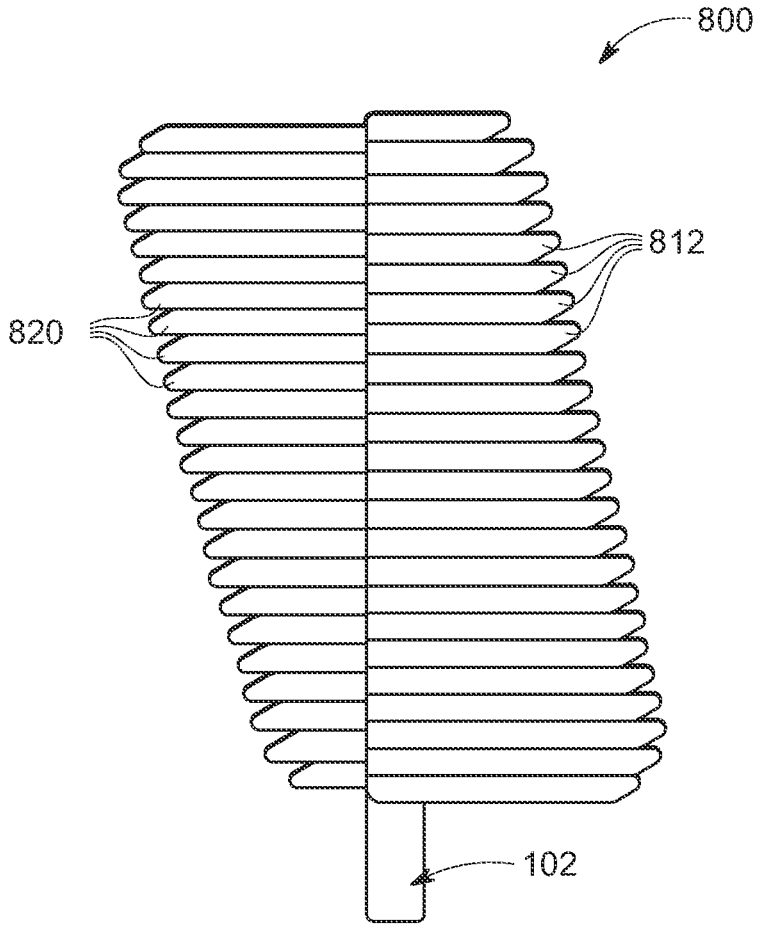
FIG. 13 illustrates a fence system, in accordance with yet another embodiment of the disclosure.

Referring to FIG. 13, a fence system 800 is shown according to yet another alternative embodiment of the disclosure. The fence system 800 is similar to the fence system 700 except that the lengths of the first slats 812 increase from the top end 104 towards bottom end 106, while the lengths of second slats 820 decrease from the top end 104 towards bottom end 106. Accordingly, the outer edges of the first slats 812 define a straight line that is inclined relative to the post 102 and intersects a central longitudinal axis of the post 102 at an acute angle at a location proximate to the top end of the post 102. Similarly, the outer edges of the second slats 820 define a straight line that is inclined relative to the post 102 and intersects the central longitudinal axis of the post 102 at an acute angle at a location proximate to the bottom end of the post 102.

Figure 14:
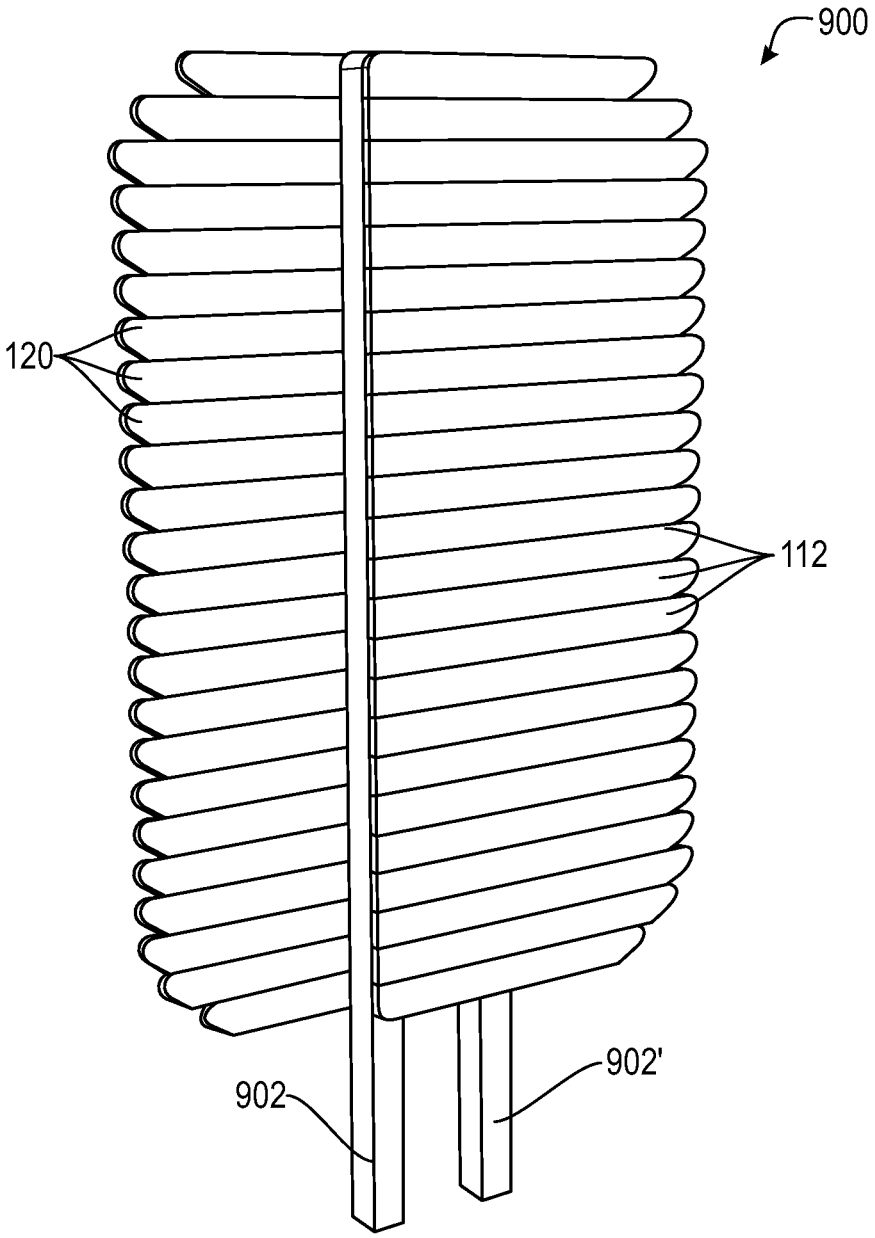
FIG. 14 illustrates a fence system having two posts, in accordance with an embodiment of the disclosure.
Figure 15:
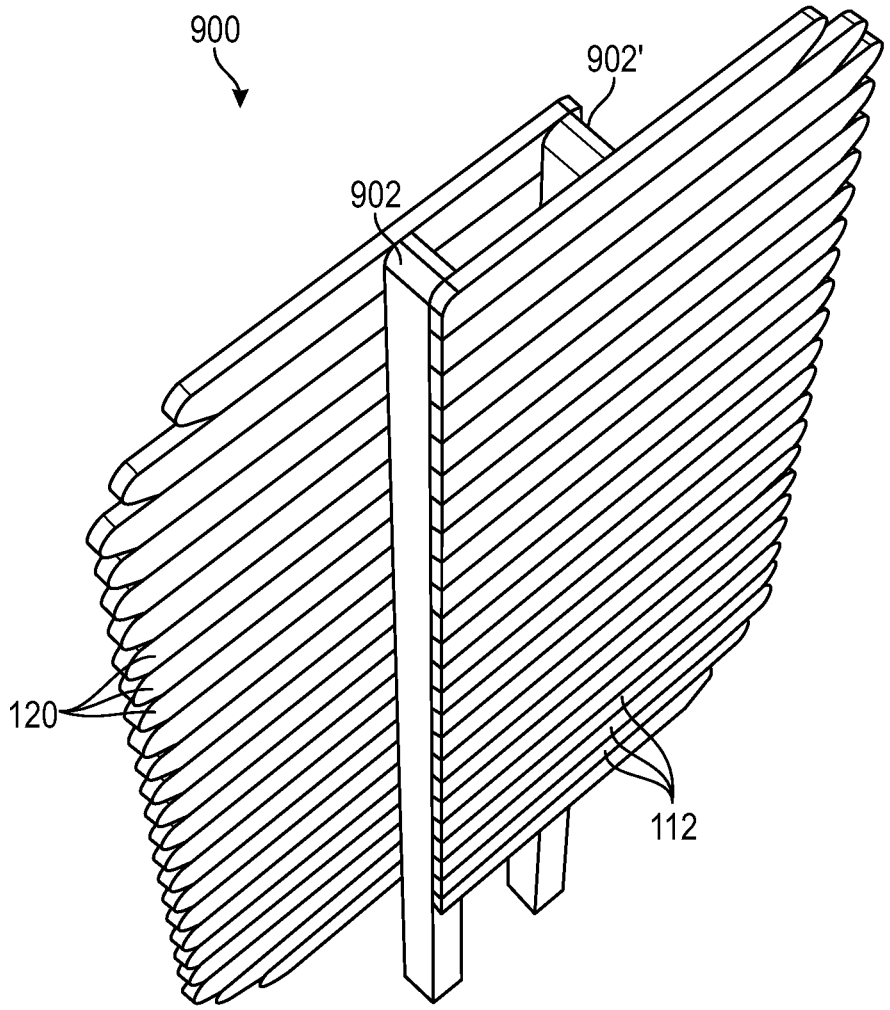
FIG. 15 illustrates a top perspective view of the fence system shown in FIG. 14.

Referring to FIGS. 14 and 15, a fence system 900 is shown according to another alternative embodiment of the disclosure. The fence system 900 is similar to the fence system 100 shown in FIGS. 1 and 2, except that the fence system 900 includes two posts, namely a first post 902 and a second post 902'. The first slats 112 have an end that is aligned with the first post 902, and the first slats 112 extend toward and beyond the second post 902'. Similarly, the second slats 120 have an end that is aligned with the second post 902', and the second slats 120 extend toward and beyond the first post 902. It is to be appreciated that the first post 902 and the second post 902' may provide additional torsional rigidity to the fence system 900. Additionally, each of the first slats 112 and each of the second slats 120 may be secured to both the first post 902 and the second post 902' to provide additional structural strength.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The exemplary embodiment was chosen and described in order to best explain the principles of the present disclosure and its practical application, to thereby enable others skilled in the art to best utilize the present disclosure and various embodiments with various modifications as are suited to the particular use contemplated.

What is claimed is:

1. A fence comprising a plurality of fence systems, each of the fence systems comprising:

a post having a top end and a bottom end, the bottom end being configured to be secured to a ground surface;

a plurality of first slats arrayed in a vertical direction along the post and coupled to a first surface of the post, wherein the plurality of first slats extends outwardly in a horizontal direction from the post and is arranged on a first side of the post;

a plurality of second slats arrayed in a vertical direction along the post and coupled to a second surface of the post, wherein the plurality of second slats extends in a horizontal direction from the post and is arranged on a second side of the post, wherein the first surface of the post and the second surface of the post are on opposite sides of the post to one another; and wherein adjacent fence systems in the plurality of fence system at least partially overlap with one another to form the fence, such that the first slats in a first fence system at least partially overlap with the second slats in a second fence systems that is adjacent to the first fence system, and further wherein the first slats in the second fence system at least partially overlap with the second slats in a third fence system; and wherein the lengths of the first slats and the second slats vary from the top end of the post to the bottom end of the post, such that the lengths of the first slats and the second slats increase from the top end to a central portion of the post, and the lengths of the first slats and the second slats then decrease in length from the central portion towards the bottom end of the post.

2. The fence of claim 1 wherein at least one of the fence systems is a corner fence system, wherein in the corner fence system the first surface of the post and the second surface of the post are perpendicular to one another such that the plurality of first slats and the plurality of second slats extend in directions.

3. The fence of claim 1 wherein the fence systems comprise at least three uniquely different shapes from one another.

4. The fence of claim 3 wherein the overlapping first slats and second slats of the adjacent fence systems are secured together with fasteners.

5. The fence of claim 1 wherein the overlapping first slats and second slats of the adjacent fence systems are secured together with fasteners.

6. The fence of claim 1 wherein the fence system includes a second post.

7. The fence of claim 1 wherein the fence systems comprise at least three uniquely different shapes from one another.

8. The fence of claim 7 wherein the overlapping first slats and second slats of the adjacent fence systems are secured together with fasteners.

9. The fence of claim 7 wherein the fence system includes a second post.

10. The fence of claim 1 wherein the overlapping first slats and second slats of the adjacent fence systems are secured together with fasteners.

11. The fence of claim 1 wherein the fence system includes a second post.

12. The fence of claim 1 wherein the first slats and the second slats are secured to the post at an angle of 30 degrees to 150 degrees.

13. A fence comprising a plurality of fence systems, each of the fence systems comprising:

a post having a top end and a bottom end, the bottom end being configured to be secured to a ground surface;

a plurality of first slats arrayed in a vertical direction along the post and coupled to a first surface of the post, wherein the plurality of first slats extends outwardly in a horizontal direction from the post and is arranged on a first side of the post;

a plurality of second slats arrayed in a vertical direction along the post and coupled to a second surface of the post, wherein the plurality of second slats extends in a horizontal direction from the post and is arranged on a second side of the post; and wherein adjacent fence systems in the plurality of fence system at least partially overlap with one another to form the fence, such that the first slats in a first fence system at least partially overlap with the second slats in a second fence systems that is adjacent to the first fence system, and further wherein the first slats in the second fence system at least partially overlap with the second slats in a third fence system; and wherein the lengths of the first slats and the second slats vary from the top end of the post to the bottom end of the post, such that the lengths of the first slats and the second slats increase from the top end to a central portion of the post, and the lengths of the first slats and the second slats then decrease in length from the central portion towards the bottom end of the post.

14. The fence of claim 13 wherein at least one of the fence systems is a corner fence system, wherein in the corner fence system the first surface of the post and the second surface of the post are perpendicular to one another such that the plurality of first slats and the plurality of second slats extend in directions perpendicular to one another.

15. The fence of claim 13 wherein the fence systems comprise at least three uniquely different shapes from one another.

16. The fence of claim 15 wherein the overlapping first slats and second slats of the adjacent fence systems are secured together with fasteners.

17. The fence of claim 13 wherein the overlapping first slats and second slats of the adjacent fence systems are secured together with fasteners.

18. The fence of claim 13 wherein the fence system includes a second post.

19. The fence of claim 13 wherein the first slats and the second slats are secured to the post at an angle of 30 degrees to 150 degrees.

* * * * *